United States Patent [19]

Briles

[11] 4,290,503

[45] Sep. 22, 1981

[54] PORTABLE SECURITY FIRE ESCAPE

[76] Inventor: Wayne A. Briles, 301 South St., Andrews Pl., #307, Los Angeles, Calif. 90020

[21] Appl. No.: 112,554

[22] Filed: Jan. 16, 1980

[51] Int. Cl.[3] ..... A62B 3/00

[52] U.S. Cl. ..... 182/47; 182/53; 182/82; 182/152

[58] Field of Search ..... 182/47, 82, 83, 84, 182/53-62, 70-76, 113, 137, 140, 150, 152

[56] References Cited

U.S. PATENT DOCUMENTS

| | | | |
|---|---|---|---|
| 284,180 | 9/1883 | Burghardt | 182/47 |
| 300,090 | 6/1884 | Larson | 182/82 |
| 487,395 | 12/1892 | Mannheim | 182/82 |
| 495,503 | 4/1893 | Martin | 182/131 |
| 3,847,246 | 11/1974 | Banner | 182/70 |
| 3,931,868 | 1/1976 | Smith | 182/63 |

*Primary Examiner*—Reinaldo P. Machado
*Attorney, Agent, or Firm*—Erik M. Arnhem

[57] ABSTRACT

A collapsible fire escape for erection within a building adjacent a window therein, comprising sets of upper and lower joists arranged spatially apart from one another and mounted pivotally, respectively to upper and lower end portions of elongated upright angle irons to form a rectangular framework, a floor mounted over the lower joists, a first set of wall covers mounted to and between the outer surfaces of the upright angle irons, a second set of wall covers removably insertable between the remaining open spaces of the upright angle irons, foldable brace sections mounted crosswise and pivotally to the connecting points of joists and upright angle irons, a continuous hinge mounted along one of the upright angle irons extending into a plate which terminates in hooks, a plate provided with tubular projections mounted to the outside wall of the building adjacent the window for receiving the hooks and the housing capable of being swung outside through the window.

13 Claims, 4 Drawing Figures

PORTABLE SECURITY FIRE ESCAPE

BACKGROUND OF THE INVENTION

1. Field of the Invention

The invention relates to a fire escape in the form of a housing, particularly for use in a high-rise building, being on fire, within which occupants and vistors are trapped, and only capable of escaping through a nearby window in the building. The housing, which is collapsible for storage, may be unfolded within the building in the case of fire, and hooked on to a hinge-like mount, prefixed outside but adjacent a window of the building, through which the housing with escaping people may be swung to a suspended position adjacent the outside wall of the building, where the escaping people then may wait for rescue.

2. Description of the Prior Art

The following U.S. patents constitute the prior art relevant to the disclosure underlying this application, as known to applicant:

U.S. Pat. No.: 284,180; BURGHARDT, 1883;
U.S. Pat. No.: 300,090; LARSON, 1884;
U.S. Pat. No.: 487,395; MANNHEIM, 1892;
U.S. Pat. No.: 495,503; MARTIN, 1893;
U.S. Pat. No.: 3,931,868; SMITH, 1976.

The above patents were developed in a search conducted in class 182, subclasses 47, 56, 57, 62, 70, 76, 82 and 150.

Mannheim discloses a device stored in and brought out of a recess in the outer wall of a building, requiring an escaping person to step out of a window into a narrow platform and then into a bag, which is lowered to the ground.

However, none of the above cited patents, including Mannheim, discloses a structure comparable to applicant's invention.

SUMMARY OF THE INVENTION

In an ever vertically expanding world, with millions of people living or working in high-rise buildings, being no longer equipped with unseemly outside stairways, suddenly erupting and quickly spreading fires with billows of smoke sweeping through hallways, stairways, practically speaking only leaves one route of escape, that is through an open or broken window. Smoke detectors are not a panacea for conflagrations; they, primarily service as a warning system of fires, but does not necessarily secure safe passage through hallways, to staircases or elevators. Recent tragedies, where people, suffocating from smoke and heat inside high-rise buildings, jumped to their deaths from windows in the buildings, undoubtedly drives home the point, that there is a real need for a practical solution to the fire hazards of living or working in high-rise buildings.

The present fire escsape was, primarily conceived to bring about a solution to this problem. Since most people have fear of heights, the invention is based on having a collapsible housing which may be erected and made ready for use in minutes within a room in the building on fire, and attached to a prefixed hinged connection on the outside wall of the building; the escaping person or persons may then step into the housing and push the housing and themselves outside the building; the housing, according to the inventor, is made of sturdy, but light material, such as e.g., an aluminum frame with four fireproof walls, a solid bottom and an open top.

It is, thus an object of the invention to provide a fire escape, into which persons may enter while still within a building, pivotally displaceable same through a window for suspended position outside the building.

It is another object of the invention to provide a fire escape housing which is collapsible, for storage when not in use.

It is still another object of the invention to provide a fire escape, which may be unfolded and made ready for use in minutes.

It is still a further object to provide a secure fire escape housing, which is easy and inexpensive to manufacture.

Further advantages and objects of the invention will readily appear from the following description of the fire escape.

DESCRIPTION OF THE PREFERRED EMBODIMENT OF THE INVENTION

Figure 1:
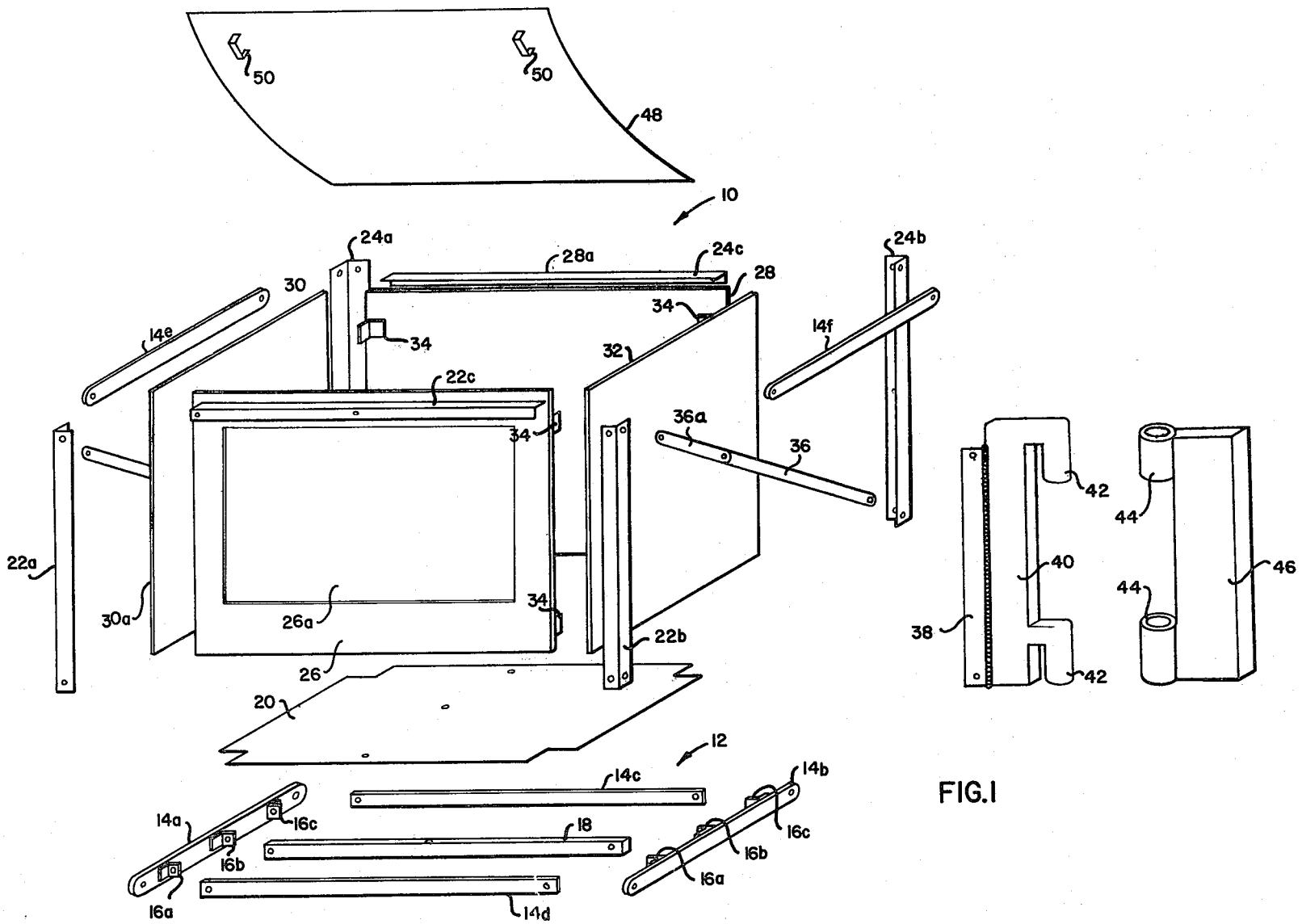
FIG. 1 is an exploded perspective view of the fire escape housing, according to the invention.

In the drawings, like reference characters, designate similar parts in the several views.

Figure 2:
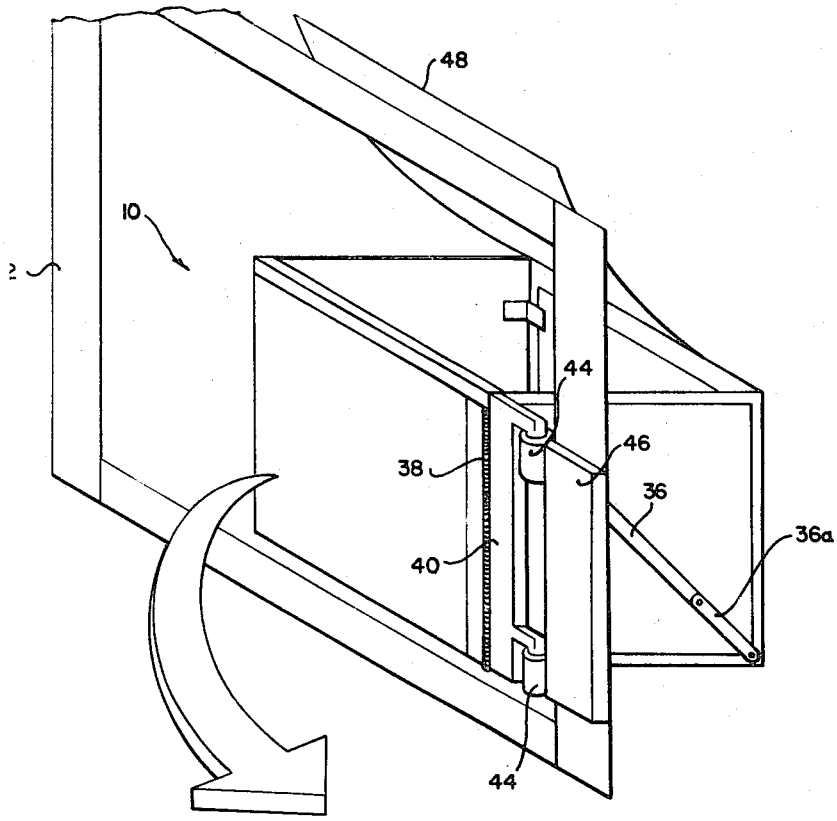
FIG. 2 is perspective view of the fire escape housing assembled and attached to a prefixed mount outside a window of a building.

Referring now in detail to the drawings, numeral 10 of FIG.2 designates the assembled fire escape housing. As it appears from the exploded view of FIG. 1, the housing 10 has a base 12, consisting of five joists 14*a, b, c, d* and 18; of which joists 14*a,* b are of shorter lengths (FIG. 1). Two sets of retaining means, e.g., angle irons 16*a, b, c* are provided; one face of angle irons 16*a* and *c* is, respectively mounted to the inwardly directed surface of joists 14*a, b* at about 3 inches from their ends; angle iron 16*b* is mounted at a center portion of joists 14*a, b;* the ends of joists 14*c, d* and 18 are then, as indicated in FIG. 1, securely mountable, e.g., bolted to the projecting face of angle irons 16*a, c* and 16*b,* respectively, to form the sturdy rectangular base 12; the width, height and length of joists 14*a, b, c, d* and 18, respectively are: $22\frac{1}{2}''$ long, 2" deep, $\frac{1}{2}''$ wide; $46\frac{3}{8}''$ long, 2" deep, $\frac{1}{2}''$ wide, and, as illustrated in FIG. 1, joists 14 rest on their narrow surfaces, that is on a $\frac{1}{2}''$ base, respectively. Furthermore, the ends of joists 14*a, b* are rounded to facilitate the folding of housing 10, according to the invention, to be explained fully in the following description.

A floor 20, having rectangular cut-outs at its corners for the purpose of facilitating the mounting and operation of housing 10, is, preferably provided with predrilled holes (as indicated in FIG. 1) for quick and easy mounting to joists 14 and 18. Elongated holding means, e.g., two sets of heavy angle irons 22*a, b* and 24*a, b* respectively are provided; each set of angle irons (22,24) consists of two upright sections (*a,b*).

Figure 4:
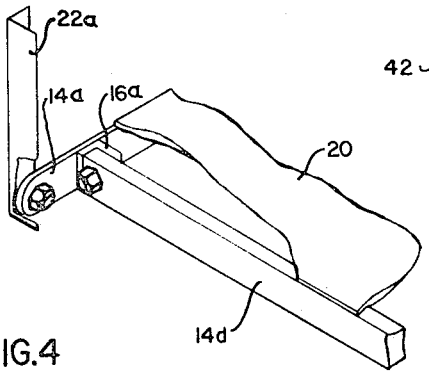
FIG. 4 is a close-up perspective view of a pivotal corner section of the housing framework.

As indicated in FIG. 4, the outwardly facing lateral end portions of joists 14*a* (or *b*) are mounted, to the faces of angle irons 22*a, b* and 24*a, b* (extending perpendicularly from joists 14*a, b*), by means of suitable pivotal connections (not shown in detail); as indicated in FIG. 1, joists 14*a, b* are so mounted to angle irons 22*a, b* and 24*a, b* that gaps are formed between the rounded ends of joists 14*a, b* and the unmounted faces of angle irons 22*a, b* and 24*a, b;* the purpose of these gaps is contributing to a frictionless mounting and folding of housing 10.

Two additional supporting means, e.g., joists 14*e* and *f,* are substantially constituted and mounted pivotally as joists 14*a, b,* to the upper end of angle irons 22*a,* 24*a,* respectively 22*b,* 24*b,* forming with the latter and joists 14*a, b* two upright wall frames.

A first set of fireproof means, e.g., asbestos sheets 26*a,* 28*a* of appropriate thickness constitute the wall covers for the long sides of housing 10; sheets 26*a,* 28*a* are, respectively reinforced by reinforcing means, e.g., sections of metal plating 26, 28, mounted by any appropriate means to and from around the upper edges of sheets 26*a,* 28*a,* partially, covering the outer surface of the latter; furthermore, stiffening means, e.g., two elongated angle irons 22*c,* 24*c* extend, respectively horizontally along the upper edges of and are, e.g., securely bolted to sheets 26*a,* 28*a* and plating 26, 28. The ends of angle irons 22*c,* 24*c,* sheets 26*a,* 28*a* and plating 26, 28, are then fastend, e.g., bolted securely to the outer unmounted portions of the upright angle irons 22*a,* 22*b* and 24*a,* 24*b,* respectively.

A second set of fireproof means, e.g. asbestos plates 30, 32, are, respectively loosely insertable (after squaring housing) between upright angle irons, 22*a,* 24*a* and 24*b* and 24*b,* forming, in conjunction with sheets 26*a,* 28*a* a four edge-to-edge walled housing 10.

A set of guiding means, e.g., four angle irons 34, are so mounted adjacent the corners of and on the inwardly facing surfaces of sheets 26*a,* 28*a,* respectively, that angle irons 34 project from the latter parallely with sheets 30, 32 and will constitute guiding and holding means for the latter sheets, when inserted therewithin.

Two foldable bracing means, e.g., comprising two pivotally (indicated at 36*a*) inter-connected and foldable brace sections 36 extend crosswise between the ends of angle irons 22*a,* 24*a* and 22*b,* 24*b,* respectively, and being mounted to the outwardly facing surfaces thereof by means of the same pivotal connections (not shown in detail) which will hold angle irons 22*a,* 24*a,* 22*b,* 24*b* pivotally together with joists 14*a,* 14*b* and 14*e,* 14*f,* as described above.

Flexible means, e.g., a heavy continuous hinge 38, one side of which is mountable vertically along one of the outer faces of angle irons 22*a, b* or 24*a, b,* e.g., bolted to the pivotal connections of the latter the other side of hinge 38 extends outwardly and integrally substantially along its entire length into a plate 40, the latter in turn terminating in fastening means, e.g., two hook-like members 42, (FIG. 2).

Figure 3:
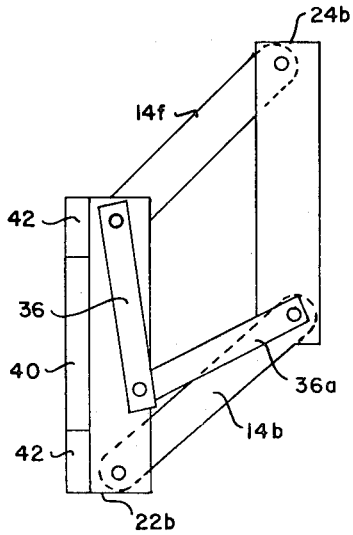
FIG. 3 is a schematic plan view of the assembled fire escape housing in a folded position.

When housing 10 is not being used, it may be folded by virtue of the pivotally inter-connected joists 14, angle irons 22*a,* 24*a,* 22*b,* 24*b* and braces 36, which then folds into a substantially flat section, as illustrated in FIG. 3, and may be stored away.

When the need arises for the use of housing 10 as a fire escape, it may quickly be unfolded and erected into the complete housing, as illustrated in FIG. 2.

Since the device, according to the invention, is preferably intended for escape from a fire through a window, a counterpart to hooks 42, in the form of receiving means, e.g., two tubular members 44 (into which hooks 42 inserts), extend integrally from a plate 46, the latter being so mounted securely to an outside wall section adjacent the window 52 (FIG. 2), that the tubular members 44 will project into the outer window space; this arrangement will facilitate the hooking up of the housing, when fire has erupted and time truly is of the essence. If a window is provided with a jamb, tubular plate 46 may be also mounted therein.

FIG. 2 illustrates housing 10 swung from inside (direction of arrow) into place outside the building, i.e., hooked into tubular means 44.

A person situated inside housing may, by virtue of its hinged connections, (manually or e.g., by means of a pole) steer housing 10 into various positions, as the situations require, for example one side of housing 10 swung into a wall abutting position, or in a position away from the building wall.

The housing may also be provided with covering means, 48 e.g., a flexible asbestos sheet which may be mounted along one of the upper edges of the housing, by any appropriate means, and be pulled by and held over the person(s) inside housing 10. Handling means, e.g., two handles 50 are mounted to the underside of sheet 48, facilitating the manipulation of the sheet from the inside of the housing 10.

Fastening means, such as bolts, screws, pivotal connections, etc., are, of course, all well known in the art, and are, therefore not illustrated or described in details in the above description.

The preferred approximate dimensions of some of the components relating to the present invention, are as follows:

Entire housing device 10: $48\frac{1}{2}\times25\frac{1}{2}$, approximate outside measurements of completed and unfolded housing.

Joists 14 (*a-b-e-f*): $22\frac{1}{2}''\times2''\times\frac{1}{2}''$

Angle irons 16: $2''\times1''$

Joists 14*c, d* and 18: $46\frac{3}{8}''\times2''\times\frac{1}{2}''$

Elongated angle irons 22*a, b;* 24*a, b:* $48''\times4''\times\frac{1}{4}''$ Angle irons (stiffeners) 22*c,* 24*c:* $48''\times1''\times$i/8''

Asbestos plates 26*a:* $48''\times48''\times\frac{1}{8}''$

Aluminum plating 26: $48''\times48''\times\frac{1}{4}''$ (with centered opening)

Asbestos plates 30: $23\frac{1}{4}''\times48''\times\frac{1}{8}''$

Hinge 38: $4''\times47''\times\frac{1}{4}''$

Plate (attached to hinge 38) 40: $24''\times48''\times\frac{1}{4}''$ and Hooks (extending from plate 40): 42

Hooks 42: 8'' long

Tubular inserts 44: 8'' long

Plate (for tubular inserts) 46: $8''\times48''$

Cut-outs of floor 20: $3\frac{3}{4}''$ (lengthwise)$\times\frac{3}{8}''$ (width).

Floor 20 (without cut-outs): $47\frac{1}{4}''\times24''$

Two diagonal braces at both ends of housing, each brace consisting of two pieces of strapped aluminum $1''\times\frac{1}{4}''$ (36, 36*a*), connected by swivel pins, shown bolted to elongated angle irons 22*a,* 24*b* (FIG. 3).

While the foregoing has illustrated and described what is now contemplated to be the best mode of carrying out the invention, the description is, of course, subject to modifications without departing from the spirit and scope of the invention. Therefore, it is not desired to restrict the invention to the particular constructions illustrated and described, but to cover all modifications that may fall within the scope of the appended claims.

I claim:

1. In a fire escape housing for erection within and outwardly swingable from an opening in a building, comprising:

(a) A collapsible housing for accomodation, when erected, of humans therewithin;

(b) articulated means one section of which is mounted to the housing;

(c) receiving means mounted to the exterior wall of the building adjacent the opening therein and connectible to an unmounted section of the articulated means.

2. Fire escape device, according to claim 1, wherein the housing includes a base of a first set of four joists arranged to form a rectangular frame and a fifth joist therewithin dividing the frame into halves; a plurality of retaining means fixedly inter-connecting the five joists; a floor fixedly mounted thereover; four holding means, respectively mounted pivotally to and extending upwardly from end portions of the four frame forming joists; a second set of two joists, end portions of which respectively are pivotally mounted to and between upper end portions of the holding means: a first set of two wall covers, respectively mounted onto and between the holding means; a second set of wall covers slidably insertable, respectively between and within the holding means, covering the remaining space there between and forming a four walled enclosure with the first set of wall covers; and foldable brace sections, respectively mounted oppositely one another to and crosswise between pivotally connecting points of the holding means and the joists.

3. Fire escape device, according to claim 2, wherein the retaining means are angle irons.

4. Fire escape device, according to claim 2, wherein the joists pivotally connected to the holding means, respectively have rounded ends.

5. Fire escape device, according to claim 2, wherein the corners of the floor are, respectively provided with cut-outs.

6. Fire escape device, according to claim 2, wherein the holding means are elongated angle irons.

7. Fire escape device, according to claim 6, wherein the joists pivotally connected to the elongated angle irons are, respectively so mounted to one face thereof, that gaps are brought about between the end surfaces of the joists and the other face of the elongated angle irons.

8. Fire escape device, according to claim 6, wherein the flexible means is a continuous hinge mounted fixedly to and along an exterior side of one of the elongated angle irons, extending into a plate, which terminates in hook-shaped projections.

9. Fire escape device, according to claim 8, wherein the receiving means is a plate from which two tubular members project for accommodation of the hook-shaped projections of the flexible means.

10. Fire escape device, according to claim 2, wherein the first and second sets of wall covers are made of asbestos, and the first set of wall covers are provided with a partially covering outwardly facing lining of protective material.

11. Fire escape device, according to claim 10, wherein the upper edge of the first set of asbestos wall covers are, respectively provided with stiffening means.

12. Fire escape device, according to claim 10, wherein a plurality of angle irons are mounted adjacent edge portions of the interior surfaces of the first set of asbestos wall covers, respectively, within which the second set of asbestos wall covers are restrained, when inserted between and within the elongated angle irons of the housing.

13. Fire escape device, according to claim 2, wherein a flexible cover is mounted along an upper edge portion of the housing, the underside thereof being provided with at least one handle.

* * * * *